US006427701B1

(12) United States Patent
Roth

(10) Patent No.: US 6,427,701 B1
(45) **Date of Patent: *Aug. 6, 2002**

(54) HAIR CURLING DISC

(76) Inventor: Joan Roth, 215 E. 80th St. Apt. 6L, New York, NY (US) 10021

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/655,658

(22) Filed: Sep. 5, 2000

Related U.S. Application Data

(60) Provisional application No. 60/152,065, filed on Sep. 2, 1999.

(51) Int. Cl.[7] ..... A45D 2/00; A45D 7/02; A45D 8/12

(52) U.S. Cl. ..... 132/245; 132/275; 132/212

(58) Field of Search ..... 132/245, 247, 132/249, 250, 252, 254, 260, 275, 212; D28/10, 39, 35

(56) References Cited

U.S. PATENT DOCUMENTS

| | | | | | |
|---|---|---|---|---|---|
| 2,276,165 | A | * | 3/1942 | Custis | 132/245 |
| D143,163 | S | * | 12/1945 | Petitta | 132/245 |
| 2,397,908 | A | * | 4/1946 | Altman | 132/245 |
| 2,430,766 | A | * | 11/1947 | Gregory | 132/245 |
| 2,513,097 | A | * | 6/1950 | Klotkowski | 132/245 |
| 2,515,751 | A | * | 7/1950 | Warrington et al. | 132/245 |
| 4,829,155 | A | * | 5/1989 | Fukutuka et al. | 219/222 |

* cited by examiner

*Primary Examiner*—John J. Wilson
*Assistant Examiner*—Robyn Kieu Doan
(74) *Attorney, Agent, or Firm*—Gifford, Krass, Groh, Sprinkle, Anderson & Citkowski, P.C.

(57) ABSTRACT

A hair curling device consists of a resilient disc having a central hole and a radial slit extending between an edge of the hole and the perimeter of the disc. A plurality of apertures formed in the surface of the disc allow rapid drying of a strand of hair wound about the disc, so as to form curls.

4 Claims, 2 Drawing Sheets

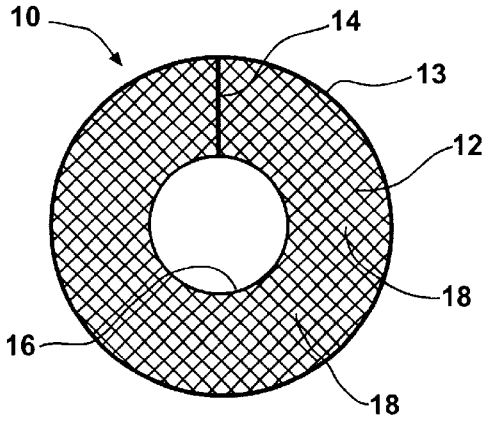
FIG - 7
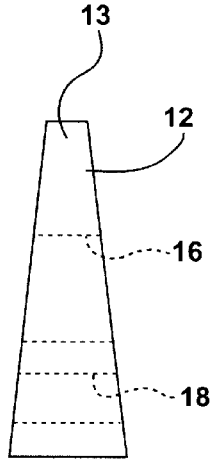
FIG - 9
FIG - 8
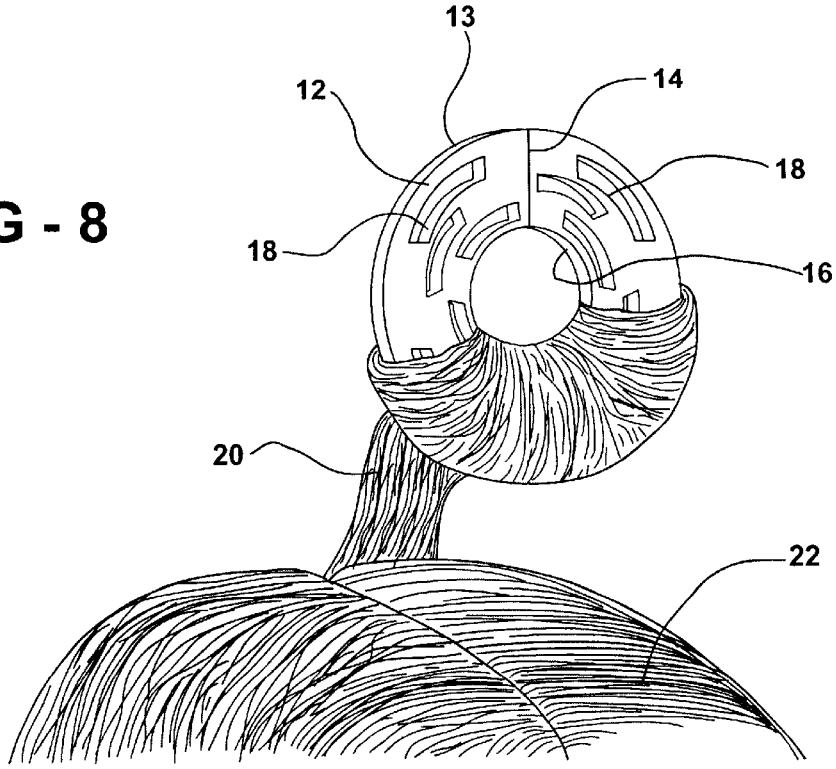

HAIR CURLING DISC

RELATED APPLICATION

This application claims the benefit of U.S. Provisional Application Serial No. 60/152,065 filed Sep. 2, 1999, and is hereby incorporated by reference.

FIELD OF THE INVENTION

The present invention relates generally to devices for curling hair, and more generally to a disc for curling hair.

BACKGROUND OF THE INVENTION

U.S. Pat. No. 2,397,908 to Clara Altman discloses a simple, low cost device for curling hair which consists of a resilient disc having a central hole and a radial slit extending from the central hole to the outer rim. In an unstressed state, the disc is flat so that the edges of the slit are adjoining one another. By imposing manual twisting forces on the disc, the edges of the slit may be separated. To curl hair, typically a woman's hair, a strand of hair is gathered and water, mousse, conditioner or similar hair preparations may be applied to the strand. The strand of hair is then wound about the disc by first threading the strand through the center hole, twisting the disc about a diametric axis so as to wind the strand about the disc, opening the slit so as to permit another section of the strand to pass through the disc into the center hole, and repeating the process until the desired amount of hair is retained on the disc. Once the hair is wound around the disc, the slit returns to its closed position thus preventing the strand of hair from unwinding.

The wound strand is allowed to dry and then the disc is removed by separating the edges of the slit and pulling it out of the wound strand.

In use, it was found that an inordinately long time was required for the wound strand of hair to dry, because the disc tended to prevent the flow of air through sections of the strand in engagement with the disc.

SUMMARY OF THE INVENTION

The present invention is directed toward a disc of the general type disclosed in the Altman patent but which has been modified by providing one or more voids in the disc surface so as to permit increased airflow over the twisted strand and thereby decrease the length of time required for the strand to dry so that the disc may be removed.

DETAILED DESCRIPTION OF THE DRAWING

Other objects, advantages and applications of the present invention will be made apparent by the following detailed description of several preferred embodiments of the invention. The description makes reference to the accompanying drawings in which:

FIG. 7 illustrates an embodiment of the invention wherein the disc is formed of a fine mesh having a large number of voids to increase the airflow over a wound strand while maintaining the structural stiffness and rigidity of the disc;

FIG. 8 is a perspective view illustrating a strand of hair wound about an embodiment of the disc employing semi-circular slots arrayed about the central hole; and FIG. 9 is a side view of an embodiment of the invention employing a disc of tapered thickness.

DETAILED DESCRIPTION OF THE INVENTION

Figure 1:
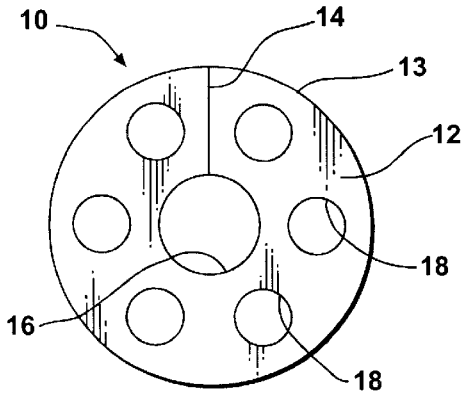
FIG. 1 illustrates a first embodiment of the disc incorporating a plurality of circular holes arranged circumferentially about the surface of the disc.

Referring to the drawings, FIG. 8 shows an elongated strand of hair 20 extending from a scalp 22. The strand is manually gathered and then is wetted by water, mousse, conditioner or other hair preparation to enable the strand to retain its curled shape. The strand is then placed through one of the embodiments of the invention, all of which comprise a thin disc 12 formed of a resilient plastic or metal and having a radial slot 14 connected to a central hole 16. The discs 12 all have a series of apertures 18 formed in some manner about their perimeter. They also have a slit 14 extending radially between the central aperture 16 and the outer perimeter 13.

Figure 2:
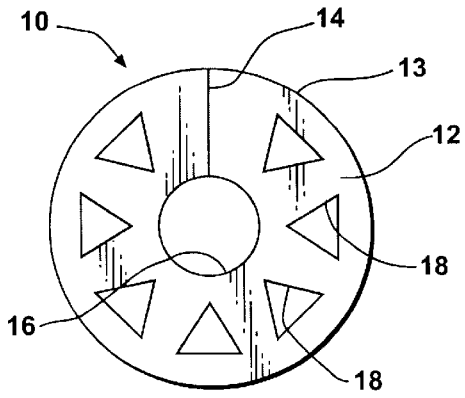
FIG. 2 shows another embodiment of the invention employing an array of triangular shaped holes.
Figure 3:
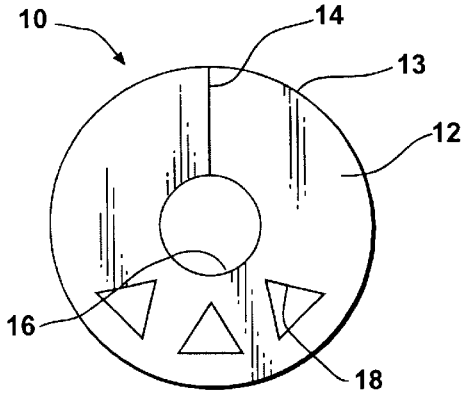
FIG. 3 illustrates an embodiment of the invention wherein the holes in the disc are arrayed on the side of the disc opposite to the slit so as to minimize the effect of formation of the holes on the structural integrity of the disc.
Figure 4:
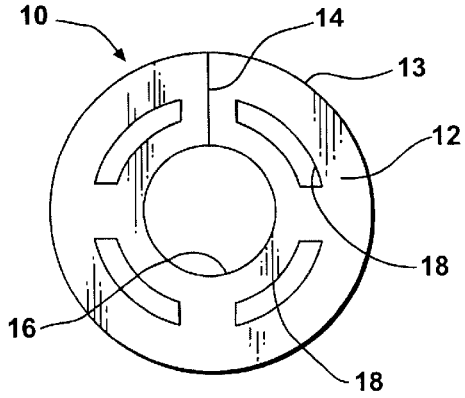
FIG. 4 illustrates an embodiment of the invention wherein an array of semi-circular slits are formed about the central hole of the disc.
Figure 5:
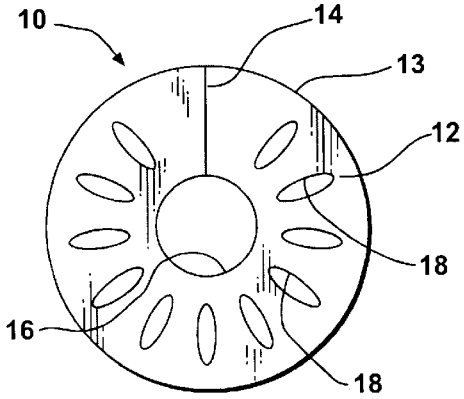
FIG. 5 illustrates an embodiment of the invention wherein a plurality of radially oriented oval shaped slots are formed about the central hole of the disc.
Figure 6:
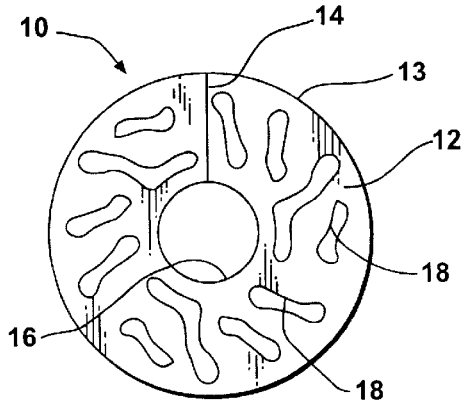
FIG. 6 illustrates an embodiment of the invention wherein irregularly shaped apertures are formed about the surface of the disc.

The apertures 18 in the embodiment of FIG. 1 consist of circular holes formed in a circular array about the center aperture 60. In the embodiment of FIG. 2, the apertures 18 are diamond shaped and are similarly formed in a uniform array about the central hole 60. The embodiment of FIG. 3 only includes three diamond shaped apertures formed in the disc on the surface opposite the slit 14. The embodiment of FIG. 4 employs a plurality of radially shaped slits 18 formed about the center hole 16. The embodiment of FIG. 5 employs a plurality of elongated oval shaped voids oriented radially in an array about the central hole 16. The embodiment of FIG. 6 employs a plurality of irregularly shaped voids spaced about the surface of the disc. The embodiment of FIG. 7 is formed of a fine mesh having a large number of voids 18 which further increases the airflow over the strand 20 while maintaining the structural stiffness and rigidity of the disc 12. The embodiment of FIG. 8 includes a plurality of semi-radial slits arrayed about the central hole. In the embodiment of FIG. 9, the disc has a non-uniform thickness to enhance the stiffness of the disc to create different curling effects on the strand 20.

As illustrated in FIG. 8, the strand of hair 20 is first gathered, then moistened as noted above and then passed through the central hole 16 of the disc. The disc is then twisted about a diametric axis so as to wind the strand about the disc and the strand is then passed through the slit 14 again. This process is repeated until the desired amount of hair is retained in the disc. Other curled strands may be similarly formed over the surface of the scalp 22.

The wound strands are allowed to air dry or are dried by a blower. The voids 18 formed through the surface of the disc substantially enhance the drying action and reduce the time the discs must remain in place.

When the strands are fully dried, the discs are twisted manually so as to open the slits 14 and are removed from the strand which retains its curled condition.

Having thus described by invention I claim:

1. A device for curling hair comprising a resilient disc of non-uniform thickness having a central hole and a radial slit extending from the central hole to the outer perimeter of the disc whereby when the disc is in an unstressed condition the edges of the slit are adjoining one another and when manual twisting forces are imposed on the disc the edges of the slit may be separated, and a plurality of voids formed about the surface of the disc to enhance the flow of air through a strand of hair wound about the disc to allow a moistened strand to quickly dry.

2. The hair curling device of claim 1 wherein the voids are regularly formed over the surface of the disc.

3. The hair curling device of claim 1 wherein the disc is formed of a fine mesh material having a plurality of uniform voids about its surface.

4. The device for curling hair of claim 1 wherein the disc has a thickness which tapers from a minimum adjacent one point on its perimeter to a maximum at a diametrically opposed point on its perimeter.

* * * * *